US010383506B2

(12) United States Patent
Minniti et al.

(10) Patent No.: US 10,383,506 B2
(45) Date of Patent: Aug. 20, 2019

(54) HEIGHT-ADJUSTING DEVICE FOR SHELVES OF APPLIANCES, IN PARTICULAR FOR DISHWASHER RACKS

(71) Applicant: ILLINOIS TOOL WORKS INC., Glenview, IL (US)

(72) Inventors: Bruno Minniti, Milan (IT); Daniele Turetta, Ispra (IT); Nicola Sartori, Comerio (IT)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 15/937,447

(22) Filed: Mar. 27, 2018

(65) Prior Publication Data

US 2018/0289236 A1 Oct. 11, 2018

(30) Foreign Application Priority Data

Apr. 11, 2017 (IT) ..... 102017000040098

(51) Int. Cl.
*A47L 15/50* (2006.01)
*A47B 88/407* (2017.01)
(Continued)

(52) U.S. Cl.
CPC ..... *A47L 15/504* (2013.01); *A47B 88/407* (2017.01); *A47B 88/427* (2017.01);
(Continued)

(58) Field of Classification Search
CPC ..... A47L 15/50; A47L 15/504; A47L 15/507; A47L 15/4246; A47L 15/503; A47L 15/502; A47L 15/506; A47L 15/28; A47B 88/407; A47B 2210/0054; A47B 2210/0024; A47B 51/00; A47B 57/06; A47B 2088/401; A47B 2210/17; A47B 46/005; A47B 2088/901; A47B 88/427; A47B 2210/04; A47B 2088/4278;
(Continued)

(56) References Cited

U.S. PATENT DOCUMENTS 3,560,069 A * 2/1971 Doepke ..... A47L 15/504 312/311
3,734,589 A * 5/1973 Morgan ..... A47B 51/00 312/311
(Continued)

FOREIGN PATENT DOCUMENTS

EP 0788763 A2 8/1997
EP 0901770 A2 3/1999
(Continued)

*Primary Examiner* — Hiwot E Tefera
(74) *Attorney, Agent, or Firm* — Boyle Fredrickson, S.C.

(57) ABSTRACT

A height adjusting device for shelves of appliances, in particular for dishwasher racks, has a pivoting stop element that can swing on its own weight between an engaged and disengaged position about a pivot point attached to a support. The stop element, when in the engaged position, interacts with a bracket on a shelf as it is raised with respect to the support to engage stop seats on that bracket to set the rack to a given height. When the rack is fully raised, a feature of the bracket tips the pivoting stop element to the disengaged position so that the rack may be lowered.

8 Claims, 7 Drawing Sheets

(51) Int. Cl.

| | |
|---|---|
| *A47B 88/40* | (2017.01) |
| *A47B 88/427* | (2017.01) |
| *F25D 23/06* | (2006.01) |
| *F25D 25/02* | (2006.01) |
| *F25D 25/04* | (2006.01) |

(52) U.S. Cl.
CPC . *A47B 2088/401* (2017.01); *A47B 2088/4274* (2017.01); *A47B 2088/4278* (2017.01); *A47B 2210/0024* (2013.01); *A47B 2210/0054* (2013.01); *A47B 2210/0059* (2013.01); *A47B 2210/04* (2013.01); *F25D 23/067* (2013.01); *F25D 25/025* (2013.01); *F25D 25/04* (2013.01)

(58) Field of Classification Search
CPC .... A47B 2088/4274; A47B 2210/0059; A47B 88/437; Y10T 29/49716; F25D 23/067; F25D 25/04; F25D 25/025
USPC ..... 312/351, 334.4, 228.1; 211/41.8
See application file for complete search history.

(56) References Cited

U.S. PATENT DOCUMENTS 3,736,037 A * 5/1973 Doepke ..... A47B 51/00 312/311
3,768,883 A * 10/1973 Kauffman ..... A47L 15/504 108/147
3,809,451 A * 5/1974 Pitstick ..... A47L 15/504 312/351
3,822,085 A * 7/1974 Clark ..... A47L 15/504 312/311
5,474,378 A * 12/1995 Smith ..... A47L 15/504 248/297.31
5,595,200 A * 1/1997 Favaro ..... A47L 15/504 134/201
5,860,716 A * 1/1999 Good ..... A47L 15/504 312/311
6,974,040 B2 * 12/2005 Jahrling ..... A47L 15/504 211/175
7,775,378 B2 * 8/2010 Tynes ..... A47L 15/504 211/41.8
8,065,966 B1 * 11/2011 Bacon ..... A47B 9/16 108/145
8,840,201 B2 * 9/2014 Garnett ..... A47L 15/504 312/228.1
2007/0039904 A1 * 2/2007 Purushothaman .... A47L 15/503 211/41.8
2011/0031863 A1 * 2/2011 Benitsch ..... A47B 57/06 312/408
2012/0291824 A1 * 11/2012 Bhajak ..... A47L 15/504 134/135
2015/0173588 A1 * 6/2015 Bhajak ..... A47L 15/4246 312/228.1

FOREIGN PATENT DOCUMENTS

| | | | |
|---|---|---|---|
| EP | 3023719 | A1 | 5/2016 |
| FR | 2722386 | A1 | 1/1996 |
| KR | 20170036393 | A | 4/2017 |

* cited by examiner

HEIGHT-ADJUSTING DEVICE FOR SHELVES OF APPLIANCES, IN PARTICULAR FOR DISHWASHER RACKS

FIELD OF THE INVENTION

The present invention relates to a height-adjusting device for shelves of appliances, in particular for dishwasher racks.

BACKGROUND OF THE INVENTION

Electric household appliances such as dishwashers and refrigerators may be provided with shelves which are adjustable heightwise.

In particular, domestic dishwashers are typically provided with racks intended to receive the dishes to be washed. The racks can usually be extracted in order to make loading and unloading of the dishes easier. Dishwashers may be provided with devices for adjusting the height of the dishwasher racks, this function being useful for optimizing the arrangement of the load. For example, document U.S. Pat. No. 8,567,882 describes a dishwasher rack comprising a height-adjusting mechanism, including a stop cam, which engages the side wall of the rack and allows a movement of the rack upwards with respect to the height-adjusting mechanism. Adjustment of the position of the rack upwards is performed by simply displacing the rack upwards since the cam is kept by gravity in an engaged position with respect to the side wall of the rack. In order to lower the rack the cam must be locked in a disengaged position by raising the rack further. Unlocking of the cam is performed once the rack is fully lowered.

One problem of the solution known from document U.S. Pat. No. 8,567,882 is that the contact surfaces during the cam locking and unlocking operations are subject to wear and possible damage. Moreover, the mode of operation of the device is such that the rack must have a particular form.

OBJECT AND SUMMARY OF THE INVENTION

The object of the present invention is to provide a height-adjusting device for shelves of appliances, in particular for dishwasher racks, which does not require manual operations apart from supporting the shelf in order to lock/unlock it on at least one heightwise level as well as the lowered position and which allows adjustment without the device necessarily performing locking at an intermediate level before passing to a higher level.

According to the present invention, this object is achieved by a device having the features described therein.

The device according to the invention does not use the rack or shelf as an active part and therefore does not require that it should have specific geometrical forms. The device according to the invention may therefore be designed so as to be fixed to any rack/shelf. Moreover, the functional parts of the device according to the present invention are simplified compared to the solutions of the prior art.

The claims form an integral part of the teaching provided in connection with the invention.

BRIEF DESCRIPTION OF THE DRAWING

The present invention will now be described in detail with reference to the accompanying drawings provided purely by way of a non-limiting example in which.

DETAILED DESCRIPTION

In the description below a height-adjusting device for a dishwasher rack is described in detail. It is understood that the device described may be used to adjust the height of shelves also in other electric household appliances, such as refrigerators.

Figure 1:
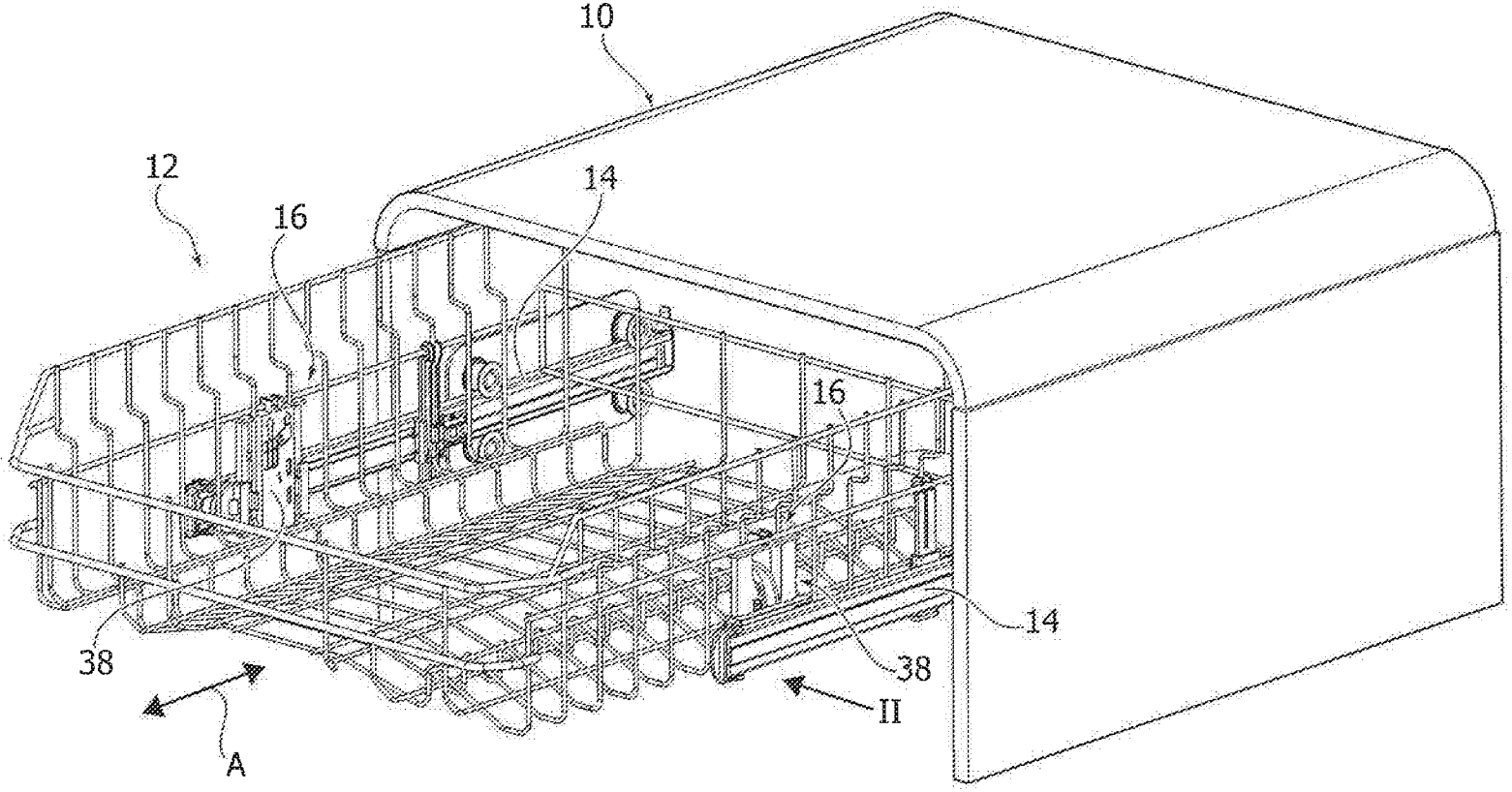
FIG. 1 is a partial perspective view of a dishwasher rack provided with a height-adjusting device according to the present invention.

With reference to FIG. 1, 10 denotes in schematic form a part of a dishwasher washing chamber. A rack 12 is housed inside the chamber 10. The rack 12 may be movable with respect to the chamber 10 in a horizontal direction indicated by the double arrow A in FIG. 1, between an extracted position (shown in FIG. 1) and a retracted position. The rack 12 may be connected to the chamber 10 by means of a pair of telescopic guides 14, of a type known per se, which allow the rack 12 to be moved in the direction A. The rack 12 is connected to the lateral guides 14 by means of two height-adjusting devices 16.

Figure 2:
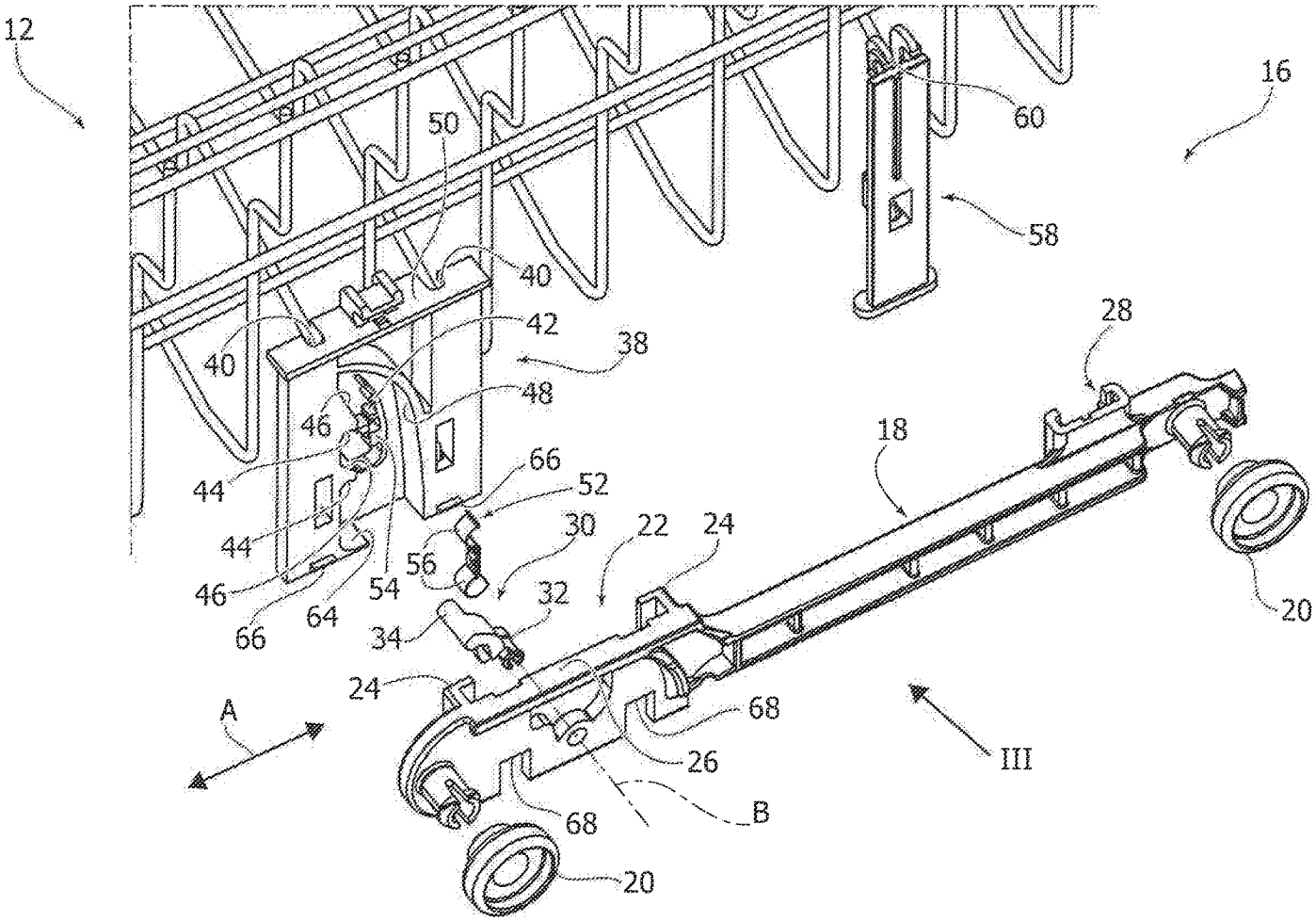
FIG. 2 is an exploded perspective view of the part indicated by the arrow II in FIG. 1.
Figure 3:
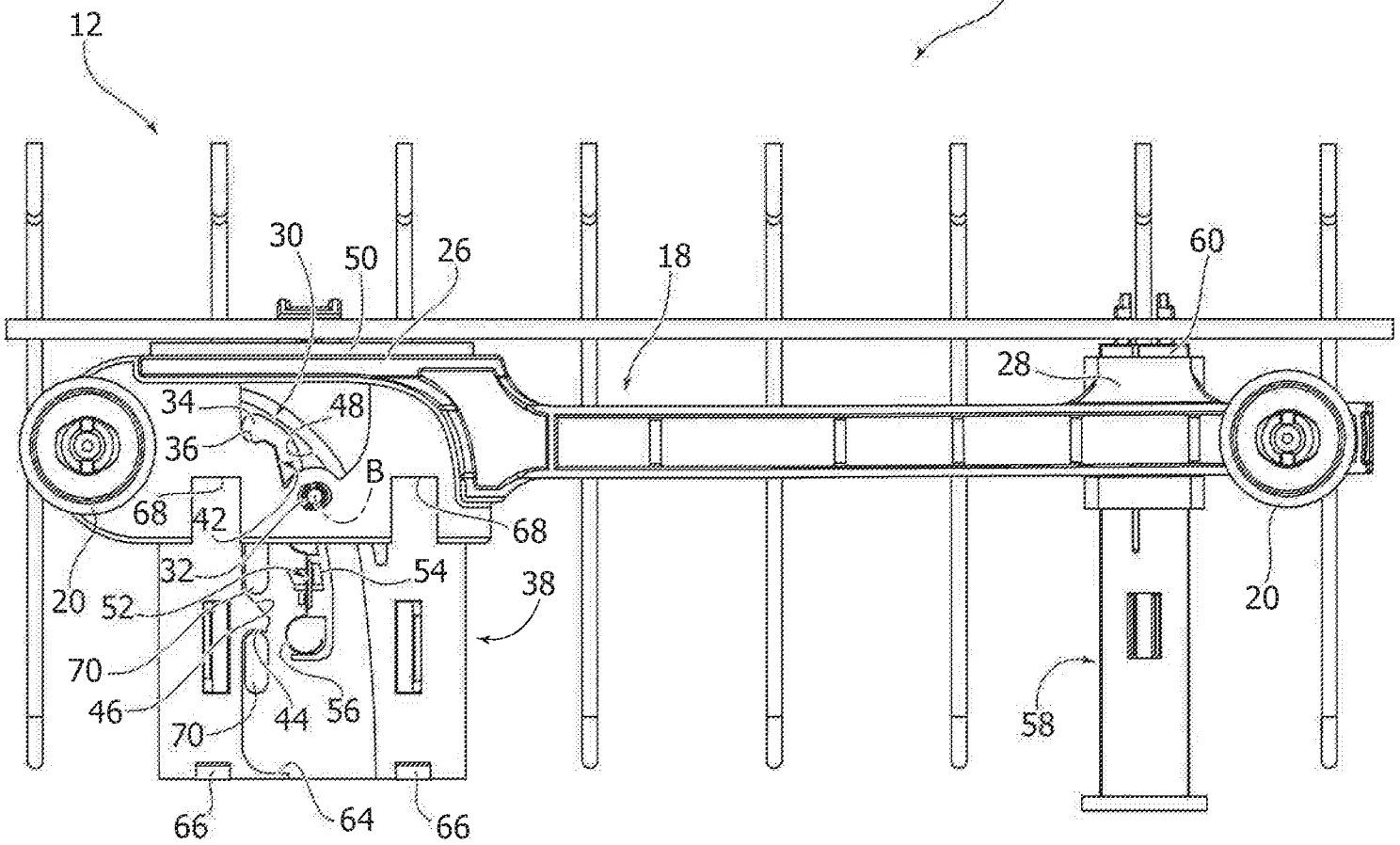
FIG. 3 is a side view in the direction of the arrow III of FIG. 2.

With reference to FIGS. 2 and 3, each height-adjusting device 16 comprises a support 18 which engages a corresponding lateral guide 14. The support 18 may be provided with a pair of wheels 20 which slidably engage with a corresponding lateral guide 14. The support 18 may be formed by a body elongated in the horizontal direction A. The support 18 comprises a main vertical guide 22 formed for example by two L-shaped projections 24 facing each other. The support 18 has an upper contact surface 26, the function of which will become clear below. The support 18 may also comprise an auxiliary vertical guide 28 with a C-shaped cross section arranged at a distance from the main vertical guide 22 in the horizontal direction A.

The height-adjusting device 16 comprises a stop element 30 hinged with the support 18 about a horizontal transverse axis B perpendicular to the direction A. The stop element 30 has a bottom end 32 hinged with the support 18 about the axis B and a latch 34 situated at the top end thereof. The stop element 30 is free to pivot about the axis B and is able to rotate about the axis B under the action of its own weight.

The stop element 30 tends to rotate about the axis B in a clockwise or anti-clockwise direction depending on the position of its centre of gravity relative to a vertical plane containing the axis B. In the drawings of FIGS. 2-7, the stop element 30 tends to rotate in an anti-clockwise direction about the axis B if its centre of gravity is displaced to the left relative to a vertical plane passing through the axis B. The stop element 30 tends instead to rotate in the clockwise direction about the axis B if its centre of gravity is displaced to the right relative to the vertical plane passing through the axis B.

The stop element 30 is in an engaged position when the latch 34, with reference to the drawings of the figures, is displaced to the left relative to the vertical plane passing through the axis B and is in a disengaged position when the latch 34 is displaced to the right relative to the vertical plane passing through the axis B. With reference to FIGS. 3 to 7, the support 18 has a semi-circular seat 36 inside which the latch 34 is intended to rest.

The height-adjusting device 16 comprises a stop bracket 38 provided with fixing formations 40 for fixing it to the side wall of the rack 12. The stop bracket 38 has a cam surface 42 which cooperates with the latch 34 of the stop element 30. The cam surface 42 has at least one stop seat 44. In the example shown, the cam surface 42 has a plurality of stop seats 44 arranged at a distance from each other in the vertical direction. The cam surface 42 has substantially a sawtooth profile with inclined sections 46 situated above the respective stop seats 44. The stop bracket 38 has a guide surface 48 facing the cam surface 42.

The stop bracket 38 engages slidably inside the vertical guide 22 of the support 18 and is freely slidable in a vertical direction relative to the support 18. From a constructional point of view, the stop bracket 38 may generally have the form of a thin plate, with two parallel lateral flanks which engage slidably with the L-shaped elements 24 of the vertical guide 22. The stop bracket 38 has an upper wall 50 which is intended to rest on the upper stop surface 26 of the support 18 in the fully lowered position of the rack 12.

The stop bracket 38 may comprise a resilient element 52 facing the cam surface 42. The resilient element 52 is optional. As will become clearer below, the resilient element 52 is not essential for the correct operation of the height-adjusting device 16. The resilient element 52 is intended to provide an optional feature which will become clear below when the mode of operation of the height-adjusting mechanism 16 is described. The resilient element 52 is mounted on a wall 54 of the stop bracket 38 situated between the cam surface 42 and the guide surface 48. The resilient element 52 may be formed by a metal plate provided with resiliently deformable protrusions 56 facing respective stop seats 44 in the cam surface 42.

With reference to FIGS. 2 and 3, the height-adjusting device 16 may comprise an auxiliary bracket 58 which engages slidably in the vertical direction inside the auxiliary guide 28 of the support 18. The auxiliary bracket 58 is provided with fixing formations for fixing it to a bar of the side wall of the rack 12. The bar of the rack 12 engaged with the auxiliary bracket 58 may form an upper stop 60 which rests on the upper surface of the auxiliary guide 28 in the fully lowered position of the rack 12. The function of the auxiliary bracket 58 is to provide the rack 12 with greater stability when it is located in a raised position. For this purpose, the auxiliary bracket 58 is located at a suitable horizontal distance from the stop bracket 38.

The mode of operation of the height-adjusting device 16 is described below.

FIG. 3 shows the height-adjusting device 16 in the fully lowered position of the rack 12. In this position the upper wall 50 of the stop bracket 38 rests on the upper contact surface 26 of the support 18. In the same way, the horizontal bar of the rack 12 with which the auxiliary bracket 58 is engaged rests on the upper surface of the auxiliary guide 28. The latch 34 of the stop element 30 rests inside the seat 36 of the support 18. The centre of gravity of the stop element 30 is displaced to the left relative to the vertical plane passing through the hinging axis B.

Starting with the configuration shown in FIG. 3, in order to adjust the height of the rack 12, the user moves the rack 12 upwards. During the upwards movement of the rack 12, the bracket 38 moves upwards in the vertical direction relative to the support 18. The latch 34 of the stop element 30 slides on the inclined surface 46 of the cam surface 42.

Figure 4:
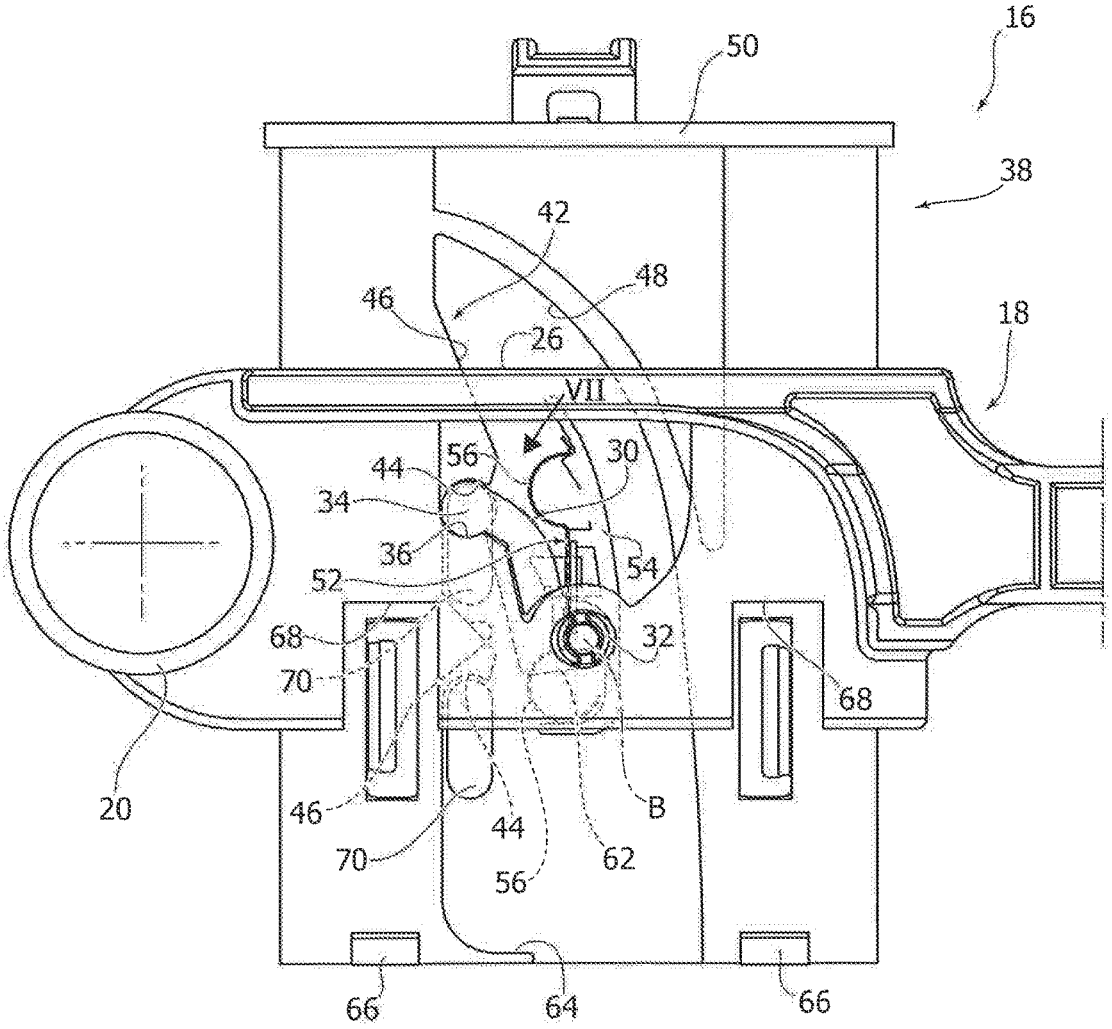
FIGS. 4, 5 and 6 are side views, on a larger scale, illustrating operation of the adjusting device according to the invention.
Figure 7:
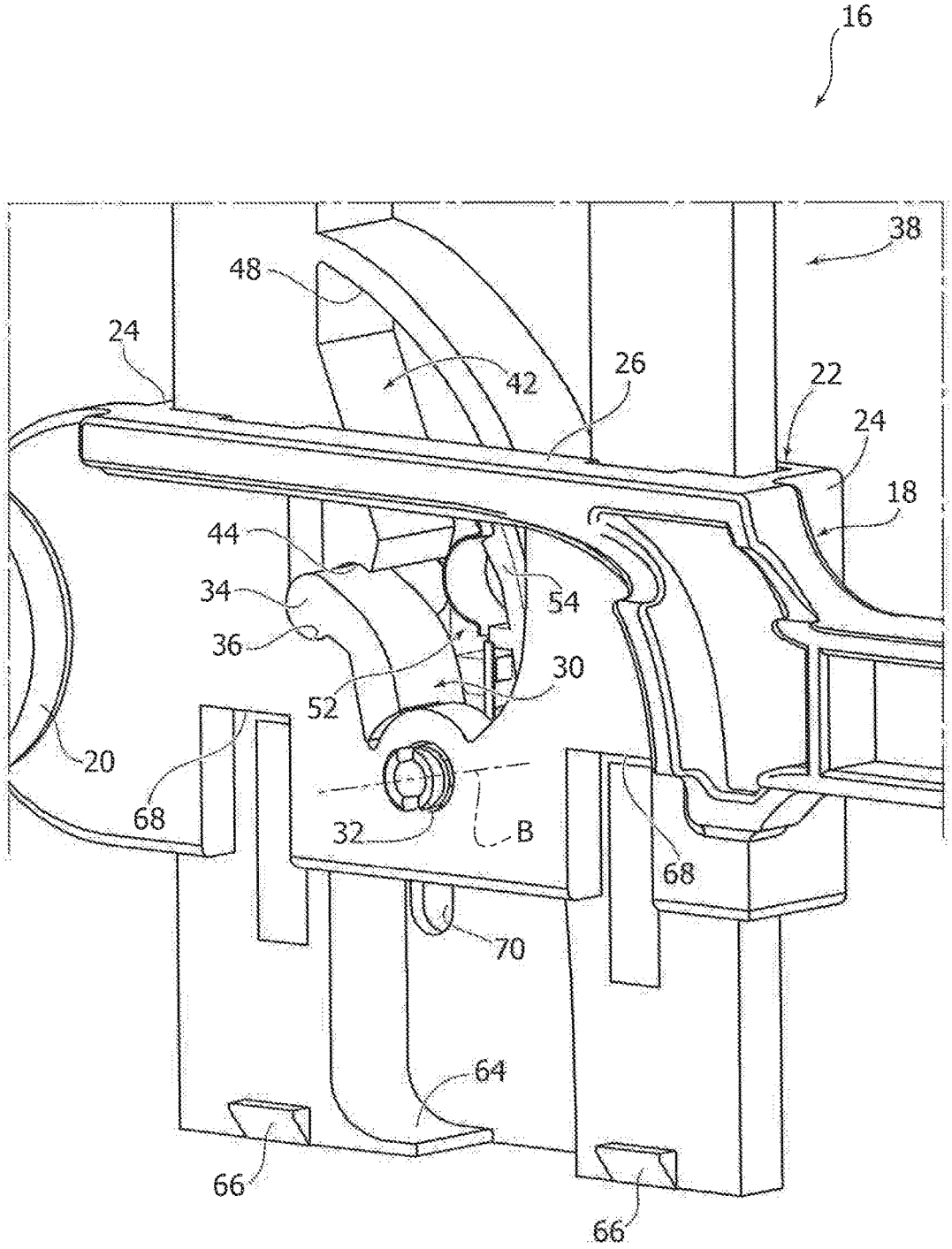
FIG. 7 is a perspective view, on a larger scale, showing the detail indicated by the arrow VII in FIG. 4.

As soon as the latch 34 passes beyond the level of the stop seat 44, the stop element 30 rotates in an anti-clockwise direction about the axis B. At this point, when the rack 12 is released, the latch 34 engages with the stop seat 44 of the cam surface 42, as shown in FIG. 4. If the resilient element 52 is present, the latch 34 resiliently deforms the protuberance 56 of the resilient element 52 when the latch 34 itself is close to the bottom end of the inclined surface 46. In this way, the user notices a slight increase in the force needed to raise the rack 12, which provides an indication of the fact that the rack 12 is in an adjustment position. When the latch 34 engages inside the stop seat 44 it is compressed between the stop seat 44 of the stop bracket 38 and the bearing seat 36 of the support 18 as shown in FIGS. 4 and 7. In this position the rack 12 is kept stably in the selected adjustment position.

The same operations may be repeated in order to bring the rack 12 into a second adjustment position. The number of adjustment positions is equal to the number of stop seats 44 in the stop surface 42. In the example shown two stop seats 44 are provided so that the height-adjusting device 16 allows three different heights of the rack 12 to be selected.

In the region of the stop seats 44 in the cam surface 42, the stop bracket 38 is provided with windows 70 which allow the user to view the position of the latch 34 during engagement inside a stop seat 44. In this way these windows 70 offer the possibility of a visual check of the adjusted height level.

In the case where the resilient element 52 is not present, the wall 54 is in any case present and forms a dividing partition which separates the adjustment position from the disengagement position. The function of the wall 54 is to prevent the stop element 30 from rotating accidentally and prematurely towards the disengagement position without engaging inside a stop seat 44.

Figure 5:
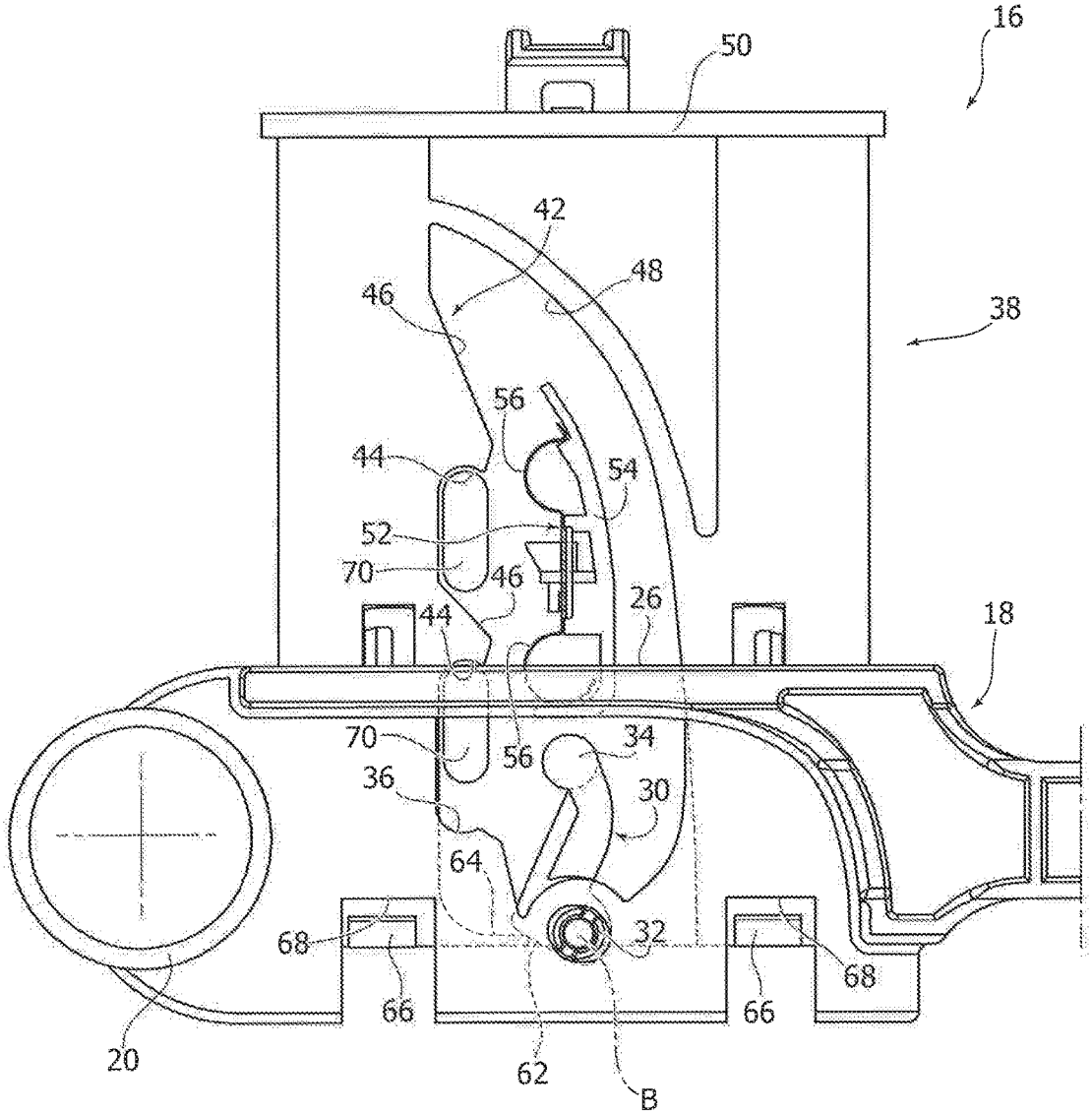
Figure 6:
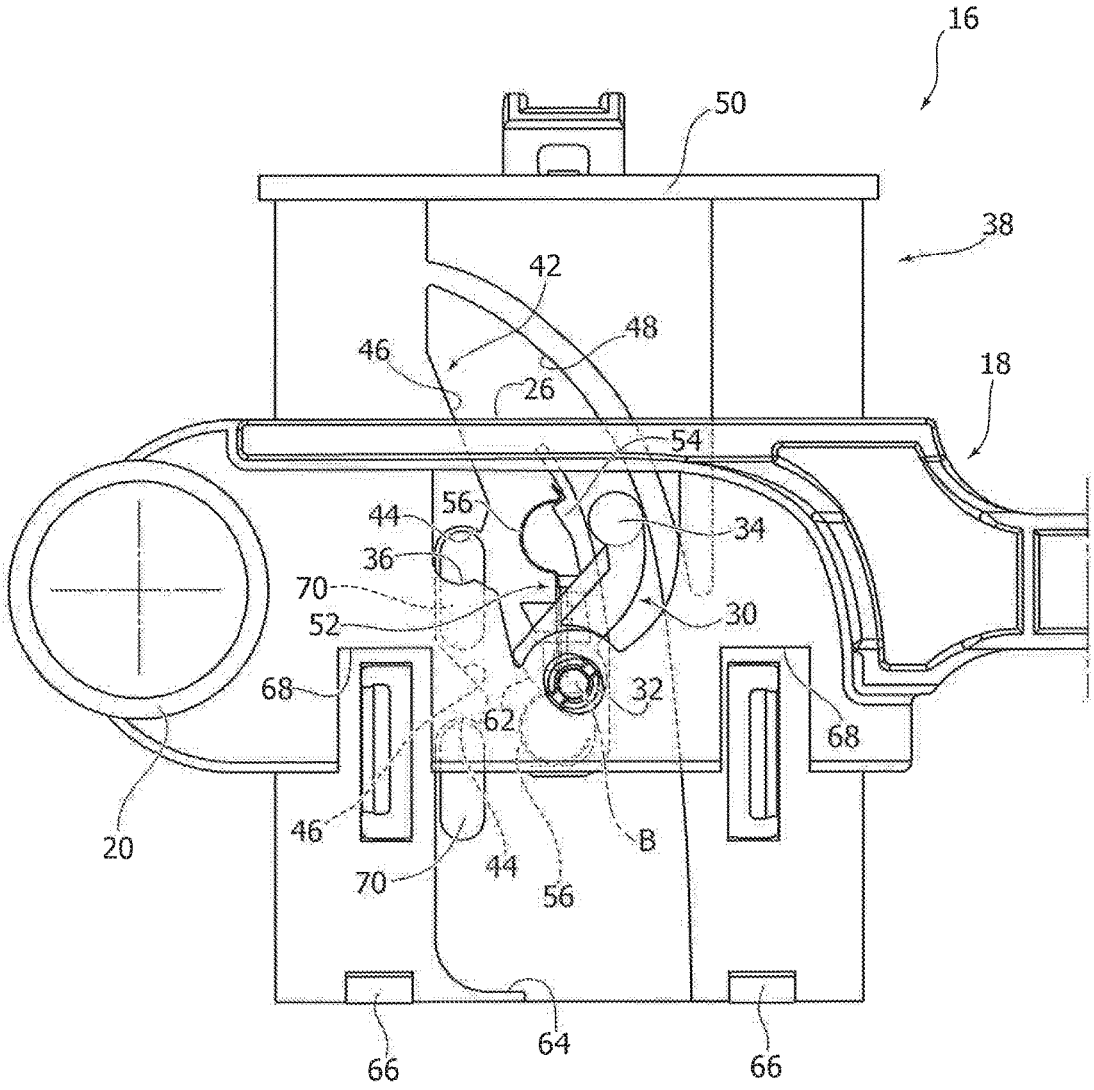

The rack 12 may be brought into the completely lowered position by means of the operations shown in FIGS. 5 and 6. During a first step, the rack 12 must be unlocked, moving the rack 12 upwards into an upper stop position defined by contact between tongues 66 located at the base of the stop bracket 38 and seats 68 formed in the support 18. With this operation the stop element 30 is pivoted from the engaged position into a disengaged position.

In fact, as shown in FIG. 5, when the rack is moved upwards into the stop position, a bottom surface 62 of the stop element 30 comes into contact with a bottom bearing surface 64 of the cam surface 42. The contact between the surfaces 62 and 64 causes the stop element 30 to pivot in a clockwise direction about the axis B. Following this oscillation, the centre of gravity of the stop element 30 is displaced to the right relative to a vertical plane passing through the hinging axis B. In this condition, the stop element 30 is in a disengaged position where the latch 34 is at a distance from the cam surface 42. The latch 34 rests against the guide surface 48 of the stop bracket 38. When the stop element 30 is in the disengaged position the rack 12 is free to move downwards. During the downwards movement of the rack 12, the latch 34 slides along the guide surface 48 as shown in FIG. 6. The guide surface 48 causes the stop element 30 to pivot about the axis B in an anti-clockwise direction so as to bring the stop element 30 back into the engagement position when the latch 34 reaches the top end of the guide surface 48. In this condition the rack 12 is in the fully lowered position shown in FIG. 3.

Obviously, without altering the principle of the invention, the embodiments and the constructional details may be greatly varied with respect to that described and illustrated, without thereby departing from the scope of the invention as defined in the accompanying claims.

The invention claimed is:

1. A height adjusting device for a rack of an appliance comprising:

a support, a stop element hinged with the support at a bottom end thereof and having a latch at a top end thereof, wherein the stop element pivots about a hinging axis under the action of its own weight between an engaged position and a disengaged position, where the latch is located on opposite sides relative to a vertical plane passing through the hinging axis, a stop bracket guided in a vertical direction relative to said support, wherein the stop bracket comprises a cam surface having at least one stop seat, which can be engaged by said latch when the stop element is in said engaged position, and a guide surface against which said stop element rests in the disengaged position, wherein the stop element has a bottom surface which is adapted to come into contact with a bottom bearing surface of the cam surface in an upper stop position of the rack and to cause pivoting of the stop element from said engaged position towards said disengaged position wherein said cam surface comprises inclined surfaces situated above said at least one stop seat against which said latch slides without moving to the disengaged position during an upwards adjustment movement.

2. The device according to claim 1, wherein said cam surface comprises a plurality of stop seats arranged at a distance from each other in the vertical direction.

3. The device according to claim 1, wherein said stop bracket comprises a wall which is arranged between said cam surface and said guide surface and which prevents said stop element from rotating into the disengaged position before engaging inside said stop seat.

4. The device according to claim 1, wherein said support comprises a main vertical guide slidably engaged by said stop bracket.

5. The device according to claim 1, wherein the stop bracket has an upper stop wall which bears against an upper stop surface of the support in a lower stop position of the stop bracket relative to the support.

6. The device according to claim 1, wherein said support comprises an auxiliary vertical guide slidably engaged by an auxiliary bracket.

7. The device according to claim 1, wherein said stop bracket is provided with windows which allow viewing of the position of the latch when in the engaged position inside said at least one stop seat.

8. A height adjusting device for a rack of an appliance comprising:

a support, a stop element hinged with the support at a bottom end thereof and having a latch at a top end thereof, wherein the stop element pivots about a hinging axis under the action of its own weight between an engaged position and a disengaged position, where the latch is located on opposite sides relative to a vertical plane massing through the hinging axis, a stop bracket guided in a vertical direction relative to said support, wherein the stop bracket comprises a cam surface having at least one stop seat, which can be engaged by said latch when the stop element is in said engaged position, and a guide surface against which said stop element rests in the disengaged position, wherein the stop element has a bottom surface which is adapted to come into contact with a bottom bearing surface of the cam surface in an upper stop position of the rack and to cause pivoting of the stop element from said engaged position towards said disengaged position;

wherein said stop bracket comprises a wall which is arranged between said cam surface and said guide surface and which prevents said stop element from rotating into the disengaged position before engaging inside said stop seat; and further comprising a resilient element mounted on said wall of the stop bracket and having at least one resiliently deformable protuberance facing a corresponding stop seat.

* * * * *